US007695353B2

(12) United States Patent
Moroto et al.

(10) Patent No.: US 7,695,353 B2
(45) Date of Patent: Apr. 13, 2010

(54) GRINDING WHEEL

(75) Inventors: Takayuki Moroto, Okazaki (JP); Kunihiko Unno, Okazaki (JP); Masato Kitajima, Okazaki (JP); Tomoyasu Imai, Okazaki (JP); Yasuhisa Sekiya, Okazaki (JP); Tomohiro Inagaki, Okazaki (JP); Noboru Hiraiwa, Okazaki (JP); Hiroshi Takehara, Okazaki (JP); Toshiaki Sakurai, Okazaki (JP); Shinji Soma, Osaka (JP)

(73) Assignees: Toyoda Van Moppes Ltd., Okazaki-shi (JP); JTEKT Corporation, Osaka-shi (JP)

( * ) Notice: Subject to any disclaimer, the term of this patent is extended or adjusted under 35 U.S.C. 154(b) by 405 days.

(21) Appl. No.: 11/719,102

(22) PCT Filed: Nov. 14, 2005

(86) PCT No.: PCT/JP2005/021197

§ 371 (c)(1),
(2), (4) Date: May 11, 2007

(87) PCT Pub. No.: WO2006/054674

PCT Pub. Date: May 26, 2006

(65) Prior Publication Data

US 2008/0299884 A1 Dec. 4, 2008

(30) Foreign Application Priority Data

Nov. 19, 2004 (JP) ..... 2004-335717

(51) Int. Cl.
*B23F 21/03* (2006.01)

(52) U.S. Cl. ..... 451/541; 451/542; 451/544; 451/546; 451/547

(58) Field of Classification Search ..... 451/540, 451/541, 542, 544, 546, 547
See application file for complete search history.

(56) References Cited

U.S. PATENT DOCUMENTS 5,035,087 A * 7/1991 Nishiguchi et al. ..... 451/14
7,063,608 B2 6/2006 Yoshida et al.

FOREIGN PATENT DOCUMENTS

| | | |
|---|---|---|
| EP | 1046465 | 10/2000 |
| JP | 50 44789 | 5/1975 |
| JP | 50 53987 | 5/1975 |

(Continued)

*Primary Examiner*—Eileen P. Morgan
(74) *Attorney, Agent, or Firm*—Oblon, Spivak, McClelland, Maier & Neustadt, L.L.P.

(57) ABSTRACT

In a grinding wheel in which abrasive tips for rough grinding and abrasive tips for finish grinding are alternately bonded to a periphery of a disk type base rotating about a rotation axis, each abrasive tip includes the abrasive layer formed by bonding abrasive grains and a lower layer overlaid and integrally for led with the abrasive layer. The abrasive tip is attached to the periphery of the base at the lower layer. A Young's modulus of the lower layer of the abrasive tip for finish grinding relative to a load acting on the grinding surface of the abrasive tip in an inward direction of the grinding wheel is less than that of the abrasive tip for rough grinding. Thereby, the surface of a workpiece can be both rough-ground and finish-ground with superhigh-precision surface roughness with using one grinding wheel.

9 Claims, 5 Drawing Sheets

FOREIGN PATENT DOCUMENTS

| | | | | |
|---|---|---|---|---|
| JP | 58 120471 | | | 7/1983 |
| JP | 61 071972 | | | 4/1986 |
| JP | 62 173175 | | | 7/1987 |
| JP | 1 143351 | | | 10/1989 |
| JP | 02 292178 | | | 12/1990 |
| JP | 11 104940 | | | 4/1999 |
| JP | 11 188638 | | | 7/1999 |
| JP | 2002192469 | A | * | 7/2002 |
| JP | 2003039333 | A | * | 2/2003 |
| JP | 2003 266318 | | | 9/2003 |

* cited by examiner

GRINDING WHEEL

TECHNOLOGICAL FIELD

The present invention relates to a grinding wheel in which abrasive layers respectively having different properties suitable for rough grinding and finish grinding a workpiece, are alternately formed on the periphery of a disk type base.

BACKGROUND ART

In order to grind the surface of a workpiece with high-precision surface roughness a grinding machine is provided with two grinding wheel heads, on one of which a grinding wheel for rough grinding is rotatably supported, and on the other of which a grinding wheel for finish grinding is rotatably supported. The grinding machine rough-grinds the workpiece with high grinding efficiency with using the grinding wheel for rough grinding and then finish-grinds the rough-ground workpiece with high-precision surface roughness with using the grinding wheel for finish grinding. It is done that after the rough grinding with using the grinding wheel, the workpiece is lapped for high-precision surface roughness with using a lapping tape.

Further, in the centerless roll grinding machine disclosed in Japanese Unexamined Patent Publication No. 1999-104940, a wide combined grinding wheel having a grinding wheel for rough grinding 11*a*, a grinding wheel for medium finish grinding 11*b*, and a grinding wheel for finish grinding 11*c* is used as a grinding wheel 11. Further, while a roll 2, which is supported and rotated on an adjustment wheel 13, and a knife blade 14 to pass between the grinding wheel 11 and the adjustment wheel 13, the rough grinding, the medium finish grinding, and the finish grinding are conducted in one pass.

However, in the above-mentioned conventional grinding machine, as the workpiece is rough-ground by the grinding wheel for rough grinding, and thereafter finish-ground or lapped by the grinding wheel for finish grinding or by the lapping tape, it takes time to move the workpiece from a position opposite the grinding wheel for rough grinding to a position opposite the grinding wheel for finish grinding or a position opposite the lapping tape, so that the time required to perform grinding increases. Further, there is a problem that the grinding machine is expensive.

In the centerless grinding machine disclosed in Japanese Unexamined Patent Publication No. 1999-104940, when depth of cut of the grinding wheel is ultraminute, the roll 2 is not fed in an axial direction. Hence, a roll surface cannot be ground with superhigh-precision surface roughness.

Accordingly, it is a primary object of the present invention to resolve the above mentioned problem and to provide a grinding wheel capable of rough-grinding the surface of a workpiece and finish-grinding it with superhigh-precision surface roughness with using one grinding wheel.

DISCLOSURE OF THE INVENTION

To resolve the above mentioned problem and to achieve the object of the present invention, there is provided a grinding wheel, in which abrasive tips for rough grinding and abrasive tips for finish grinding are alternately bonded to a periphery of a disk type base rotating about a rotation axis. Each abrasive tip includes the abrasive layer formed by bonding abrasive grains and a lower layer overlaid and integrally formed with the abrasive layer. The abrasive tip is attached to the periphery of the base at the lower layer. A Young's modulus of the lower layer of the abrasive tip for finish grinding relative to a load acting on the grinding surface of the abrasive tip in an inward direction of the grinding wheel is less than that of the abrasive tip for rough grinding.

Thus, as the Young's modulus of the lower layer of the abrasive tip for finish grinding is less than that of the abrasive tips for rough grinding, the amount by which the grinding surface of each abrasive tip is displaced in the loading direction with respect to the load acting on the grinding surface of each abrasive tip in an inward direction of the grinding wheel at the abrasive tips for finish grinding is greater than that the abrasive tips for rough grinding.

When truing the grinding wheel, a truing tool presses the grinding surfaces of the abrasive tips in an inward direction of the grinding wheel with a strong force, so that the abrasive tips for finish grinding are elastically deformed and retreat in an inward direction of the grinding wheel farther than the abrasive tips for rough grinding, and the grinding wheel is trued more amount at the abrasive tips for rough grinding, where elastic deformation is less. For this reason, the grinding wheel after the truing has a slightly greater diameter at the grinding surfaces of the abrasive tips for finish grinding compared to at the grinding surfaces of the abrasive tips for rough grinding. And, the surface of the workpiece can be finish-ground at a low cost, in a short grinding time with superhigh-precision surface roughness.

Further, a present invention is that in the improved grinding wheel, a Young's modulus of a binder of the abrasive tip for finish grinding is less than that of the abrasive tip for rough grinding.

Thus, as the Young's modulus of the binder of the abrasive tip for finish grinding is less than that of the abrasive tip for rough grinding, the amount by which the grinding surface of each abrasive tip is displaced in the loading direction with respect to the load acting on the grinding surface of each abrasive tip in an inward direction of the grinding wheel at the abrasive tips for finish grinding is greater than that at the abrasive tips for rough grinding. This can provide a grinding wheel with simple structure, which is capable of realizing the same effects as the foregoing effects of the invention described in the claim 1.

Further, a present invention is that in the improved grinding wheel according to the first invention, each of the abrasive tips comprises the abrasive layer formed by bonding abrasive grains and a lower layer overlaid and integrally formed with the abrasive layer. Each of the abrasive tips may be attached to the periphery of the base at the lower layer. A Young's modulus of the lower layer of the abrasive tip for finish grinding is less than that of the abrasive tip for rough grinding.

Thus, as the Young's modulus of the lower layer of the abrasive tip for finish grinding is less than that of the abrasive tips for rough grinding, the amount by which the grinding surface of each abrasive tip is displaced in the loading direction with respect to the load acting on the grinding surface of each abrasive tip in an inward direction of the grinding wheel at the abrasive tips for finish grinding is greater than that at the abrasive tips for rough grinding. This can provide a grinding wheel with simple structure, which is capable of realizing the same effects as the foregoing effects of the invention described in the claim 1.

Further, a present invention is that in the improved grinding wheel according to any one of the inventions described claim 1 through 3, the abrasive tips for finish grinding and the abrasive tips for rough grinding which are adjacent to each other are bonded by an adhesive having elasticity so that each abrasive tip is capable of independently undergoing elastic deformation in the loading direction.

Thus, the abrasive tips for rough and finish grinding are bonded with each other by the adhesive having elasticity, so that they can be prevented from being separated from the disk type base. During the truing and rough-grinding, the abrasive tips for finish grinding can be elastically deformed without being restricted by the abrasive tips for rough grinding, and effectively move in an inward direction of the grinding wheel farther than the abrasive tips for rough grinding.

Further, a present invention is that in the improved grinding wheel according to any one of the inventions described claim 1 through 4, abrasive grains of at least one of the abrasive layer of the abrasive tip for rough grinding and the abrasive layer of the abrasive tip for finish grinding includes superabrasive grains Thus, as the abrasive grains of at least one of the abrasive layer of the abrasive tip for rough grinding and the abrasive layer of the abrasive tip for finish grinding are superabrasive grains, the workpiece can be efficiently ground in the state in which the abrasion of the abrasive grains is low.

A present invention is that in a grinding wheel a plurality of abrasive sections, which have abrasive layer formed by bonding abrasive grains and have respective properties, are alternately bonded to a periphery of a disk type metal base rotating about a rotation axis. The periphery of the disk type metal base is alternately provided with land regions and recess regions. The abrasive sections having respective properties include abrasive sections for rough grinding formed by electrodepositing superabrasive grains on metal plating layers in the land regions, and abrasive sections for finish grinding formed by bonding the abrasive grains in the recess regions with a binder having a Young's modulus less than that of each metal plating layer.

Thus, when truing the grinding wheel, a truing tool presses the grinding surfaces of the abrasive sections in an inward direction of the grinding wheel with a strong force, so that the abrasive sections for finish grinding are elastically deformed and retreat in an inward direction of the grinding wheel farther than the abrasive sections for rough grinding, and the grinding wheel is trued more amount at the abrasive sections for rough grinding where the superabrasive grains are electrodeposited on the metal plating layer and elastic deformation is less. For this reason, the grinding wheel after the truing has a slightly greater diameter at the grinding surfaces of the abrasive sections for finish grinding compared to at the grinding surfaces of the abrasive sections for rough grinding.

When rough grinding is performed, as the depth of cut of the grinding wheel toward the workpiece is great, the workpiece presses the grinding surfaces of the abrasive sections in the inward direction of the grinding wheel with a strong force, so that the abrasive sections for finish grinding are elastically deformed to move in the inward direction of the grinding wheel more than the abrasive sections for rough grinding, and the workpiece is rough-ground by the grinding surfaces of the abrasive sections for rough grinding, where elastic deformation is less. In the final step of finish grinding, the feed of the grinding wheel toward the workpiece is stopped. Hence, rough grinding is not carried out by the abrasive sections for rough grinding, but the grinding surfaces of the abrasive sections for finish grinding are elastically restored to the outside farther than the grinding surfaces of the abrasive sections for rough grinding, and then finish grinding is carried out on the workpiece. In this manner because the grinding surfaces of the abrasive sections for rough and finish grinding can be sequentially fed to the workpiece depending on the depth of cut of the grinding wheel toward the workpiece, the workpiece can effectively be subjected to rough grinding and finish grinding with using one grinding wheel. And, the surface of the workpiece can be finish-ground at a low cost, in a short grinding time with superhigh-precision surface roughness.

A present invention is that in the improved grinding wheel according to any one of the inventions described claim 1 through 6, the boundaries between the abrasive tips or sections for rough grinding and the abrasive tips or sections for finish grinding which are adjacent to each other are inclined with respect to the rotation axis, and the abrasive tip or section for finish grinding has a width at which the opposite ends of two adjacent abrasive tips or sections for rough grinding, between which the abrasive tip or section for finish grinding is interposed, are overlaid with each other in the rotating direction of the grinding wheel.

Thus, because the opposite ends of two adjacent abrasive tips or sections for rough grinding, between which the abrasive tip or section for finish grinding is interposed, are overlaid with each other in the rotating direction of the grinding wheel, the grinding wheel can always be in contact with the workpiece at the abrasive tip or section for rough grinding, and the abrasive tip or section for finish grinding is uniformly pressed and elastically deformed in the inward direction of the grinding wheel by means of the workpiece, and thus move in the inward direction of the grinding wheel farther than the abrasive tip or section for rough grinding.

Further, a present invention is that in the improved grinding wheel according to the invention described claim 7, the abrasive tips or sections for rough grinding have a total length equal to that of the abrasive tips or sections for finish grinding on any generating line of the grinding wheel.

Thus, because the abrasive tips or sections for rough grinding have a total length equal to that of the abrasive tips or sections for finish grinding on any generating line of the grinding wheel, the variation in grinding resistance during one turn of the grinding wheel can almost be eliminated, regardless of that the plurality of abrasive tips or sections having different properties are alternately bonded to the periphery of the disk type base.

PREFERRED EMBODIMENTS TO PRACTICE THE INVENTION

Figure 1:
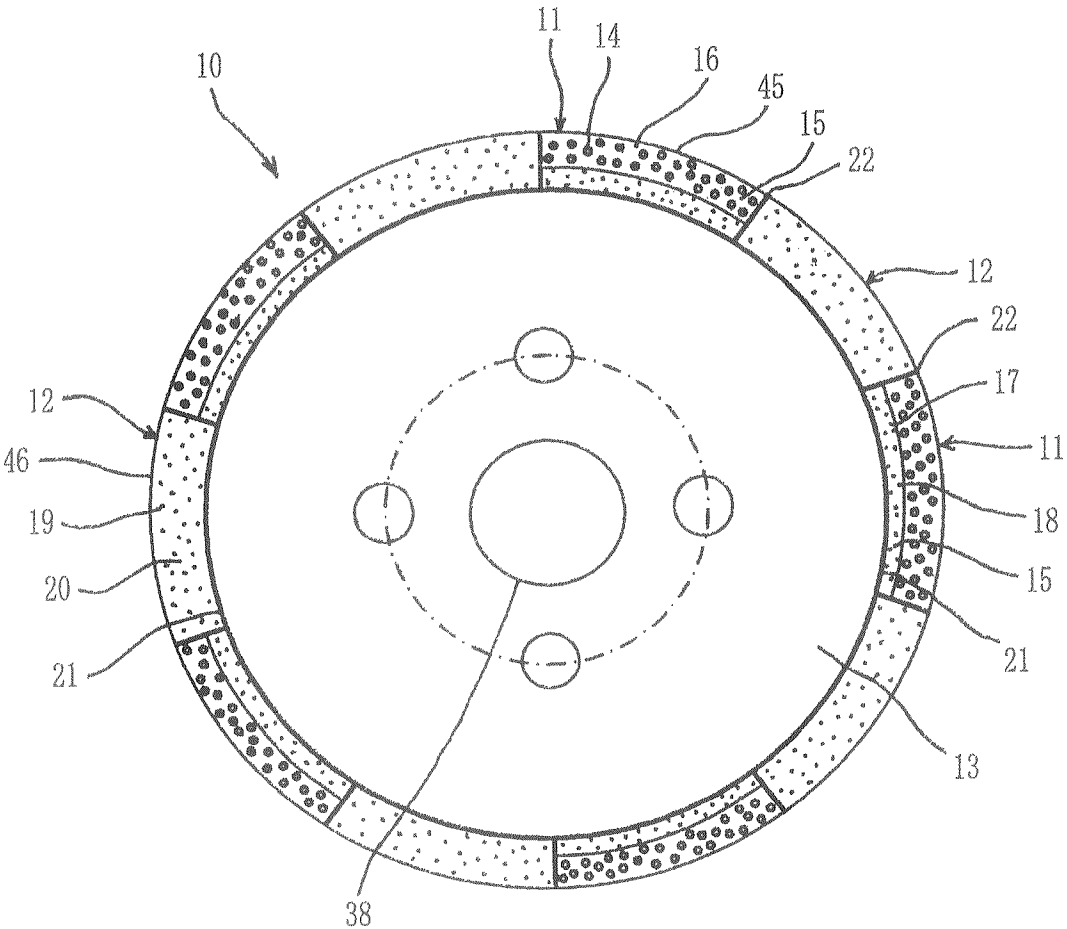
FIG. 1 is a front view illustrating a grinding wheel according to a first embodiment.

Hereinafter, a first embodiment of the present invention will be described with reference to the drawings. The grinding wheel 10 shown in FIG. 1 includes five abrasive tips 11 for rough grinding and five abrasive tips 12 for finish grinding, in which the abrasive tips for rough grind and finish grinding have different properties each other. The abrasive tips 11 and 12 for rough and finish grinding are alternately bonded on a periphery of a disk type base 13 that rotates around a rotating axis and is formed of metal, such as iron or aluminum, or resin. Each abrasive tip 11 for rough grinding has an arcuate shape, and is integrally formed in such a manner that a abrasive layer 16 formed by bonding superabrasive grains 14 such as cubic boron nitride (CBN), diamond, etc with a binder 15, is formed on a periphery thereof, and a lower layer 17 containing no superabrasive grains is overlaid with the abrasive layer 16 inside the abrasive layer 16. The abrasive layer 16 has an example in which CBN abrasive grains having a grain size of #80 are bonded by the vitrified binder 15 at a concentration of 200 and at a thickness between 3 mm and 5 mm. The lower layer 17 is formed by bonding grains 18 for the lower layer with the vitrified binder 15 at a thickness between 1 mm and 3 mm.

The abrasive tip 11 for rough grinding is made in such a manner that powder for the abrasive layer, which is formed by mixing the superabrasive grains 14, the binder 15, etc. to constitute the abrasive layer 16, is filled in a concave arcuate press lower mold at a uniform thickness, and is temporally pressed by a first upper mold, and thereby the abrasive layer 16 is temporally molded in an arcuate shape. Then, powder for the lower layer including the grains 18 is filled at a uniform thickness on the powder for the abrasive layer temporally formed by pressing, and is pressed together with the powder for the abrasive layer by a second upper mold. Thereby, the lower layer 17 is overlaid inside the abrasive layer 16, and thus is integrally molded with the abrasive layer 16, so that the arcuate abrasive tip for rough grinding is formed by pressing. Thereafter, the pressed abrasive tip for rough grinding is dried and calcinated to complete the abrasive tip 11 for rough grinding.

The abrasive tip 12 for finish grinding is formed by bonding the superabrasive grains 19, such as CBN, diamond, etc, with a binder 20, the Young's modulus of which is less than that of the binder 15 of the abrasive tip 11 for rough grinding. For example, the abrasive tip 12 for finish grinding is formed in such a manner that the CBN superabrasive grains having a grain size of #800 are bonded in an arcuate shape at a concentration of 30 at a thickness between 4 mm and 8 mm by means of a resinoid binder 20. As an example of the resinoid binder 20, phenol resin is used.

The abrasive tips 11 for rough grinding and the abrasive tips 12 for finish grinding, both of which are formed at the same thickness, are alternately arranged on the periphery of the disk type base 13, and then an arcuate bottom of the lower layer 17 of each abrasive tip 11 for rough grinding and an arcuate bottom of each abrasive tip 12 for finish grinding are adhered on the periphery of the disk type base 13 with using an adhesive 21. Because the Young's modulus of the resinoid binder 20 of each abrasive tip 12 for finish grinding is less than that of the vitrified binder 15 of each abrasive tip 11 for rough grinding the amount at which the grinding surface 46 of each abrasive tip 12 for finish grinding is displaced in a loading direction with respect to a load acting on the periphery 46 of each abrasive tip 12 toward the inner center of rotation of the grinding wheel 10 is greater than that at which the grinding surface 45 of each abrasive tip 11 for rough grinding is displaced in the Wading direction with respect to the lad acting on the periphery 45 of each abrasive tip 11 toward the inner center of rotation of the grinding wheel 10. Ends of the neighboring abrasive tips 11 and 12 for rough and finish grinding are bonded with using an epoxy adhesive 22 such that the neighboring abrasive tips 11 and 12 for rough and finish grinding can independently carry out elastic deformation in the loading direction.

Figure 2:
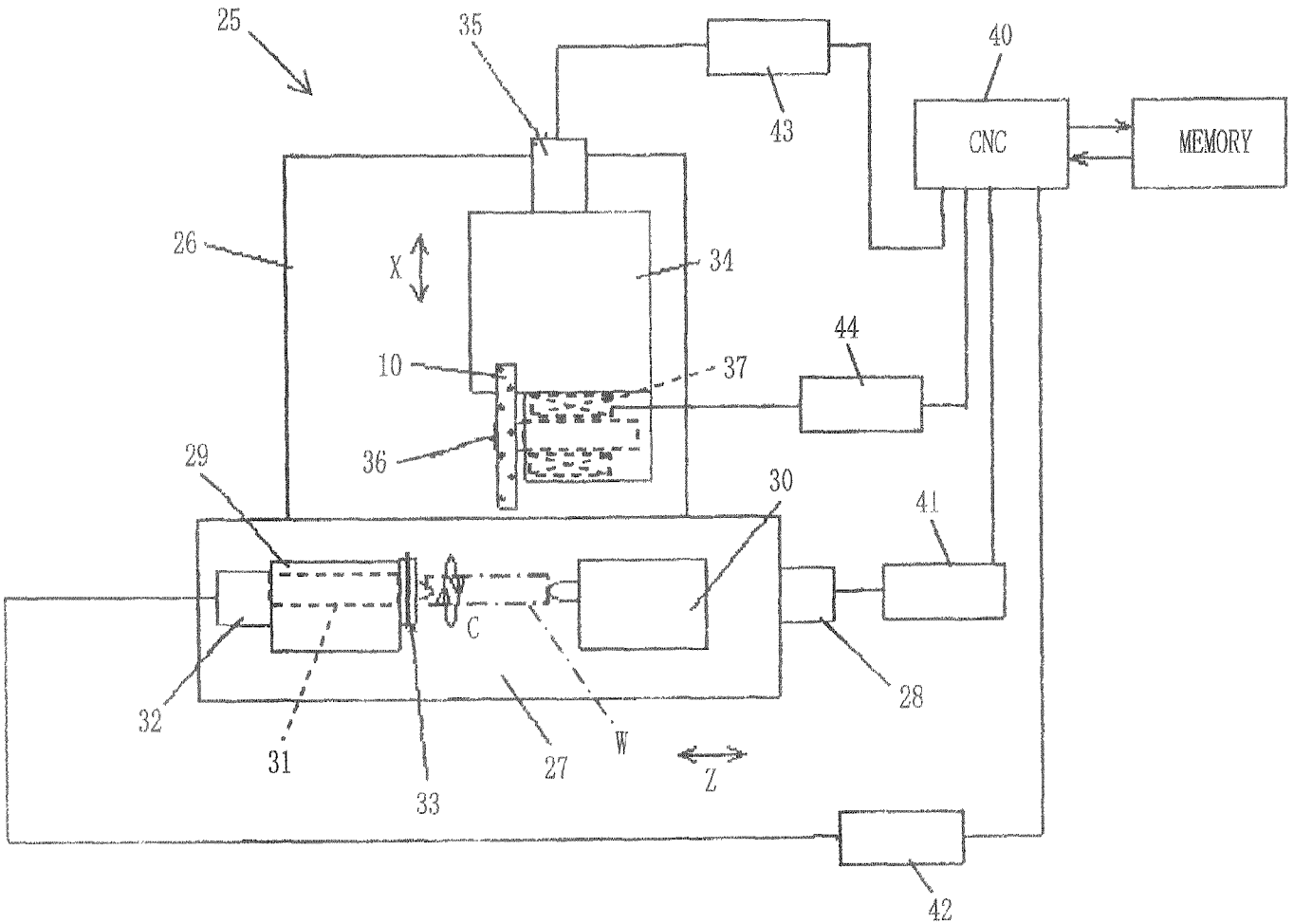
FIG. 2 illustrates a grinding machine on which a grinding wheel according to a first embodiment is mounted.

Next, a grinding machine 25 with the grinding wheel 10 mounted thereon to grind a workpiece W will be described with reference to FIG. 2. A table 27 is slidably mounted on a bed 26, and is moved in a Z-axial direction by means of a bail screw drived by a servo motor 28. A headstock 29 and a footstock 30 are oppositely mounted on the table 27, and the workpiece W is supported in the Z-axial direction between the headstock 29 and the footstock 30 with center holes. A spindle 31 is rotatably journalled in the headstock 29, and is rotated by a servo motor 32. The workpiece W is connected to the spindle 31 by means of a carrier, etc to be rotated thereby. A truing tool 33 for truing the grinding wheel 10 is coaxially fixed to a front end of the spindle 31.

A grinding wheel head 34 is slidably mounted on the bed 26, and is moved in an X-axial direction perpendicular to the Z-axial direction by means of a ball screw drived by a servo motor 35. A grinding wheel spindle 36 is rotatably journalled in the grinding wheel head 341 and is rotated by a built-in motor 37. A fitting hole 38 formed in the disk type base 13 of the grinding wheel 10 is fit to the front end of the grinding wheel spindle 36 to fix the grinding wheel 10 to the spindle 36 by bolts.

A computerized numerical controller (CNC) 40 is connected to driving circuits 41, 42 and 43 of the servo motors 28, 32 and 35 and a driving circuit 44 of the built-in motor 37. The CNC 40 executes a NC (numerical control) program for truing to true the grinding wheel 10 while truing, and a NC program for grinding in order to grind the workpiece W with the grinding wheel 10 while grinding.

Next, the operation of the above-mentioned embodiment will be described. When truing the grinding wheel 10, the CNC 40 executes the NC program for truing to output a rotation instruction for rotating the grinding wheel 10 at a low speed to the driving circuit 44 of the built-in motor 37 and then to output a rotation instruction for rotating the truing tool 33 in reverse relative to the grinding wheel 10 at a low circumferential speed suitable for truing to the driving circuit 42 of the servo motor 32 for rotating the spindle 31 Next, an advance instruction for advancing the grinding wheel head 34 in the X-axial direction is outputted to the driving circuit 43 of the servo motor 35, so that the grinding surfaces 45 and 46 of the abrasive tips 11 and 12 for rough and finish grinding of the grinding wheel 10 are advanced by a depth of cut toward the peripheral surface of the truing tool 33. And a traverse instruction for traversing the table relative to the grinding wheel head 34 depending on the truing shape at the truing speed is outputted to the driving circuits 41 and 43 of the servo motors 28 and 35, so that the grinding surfaces 45 and 46 of the grinding wheel 10 are trued by the truing tool 33.

Figure 3:
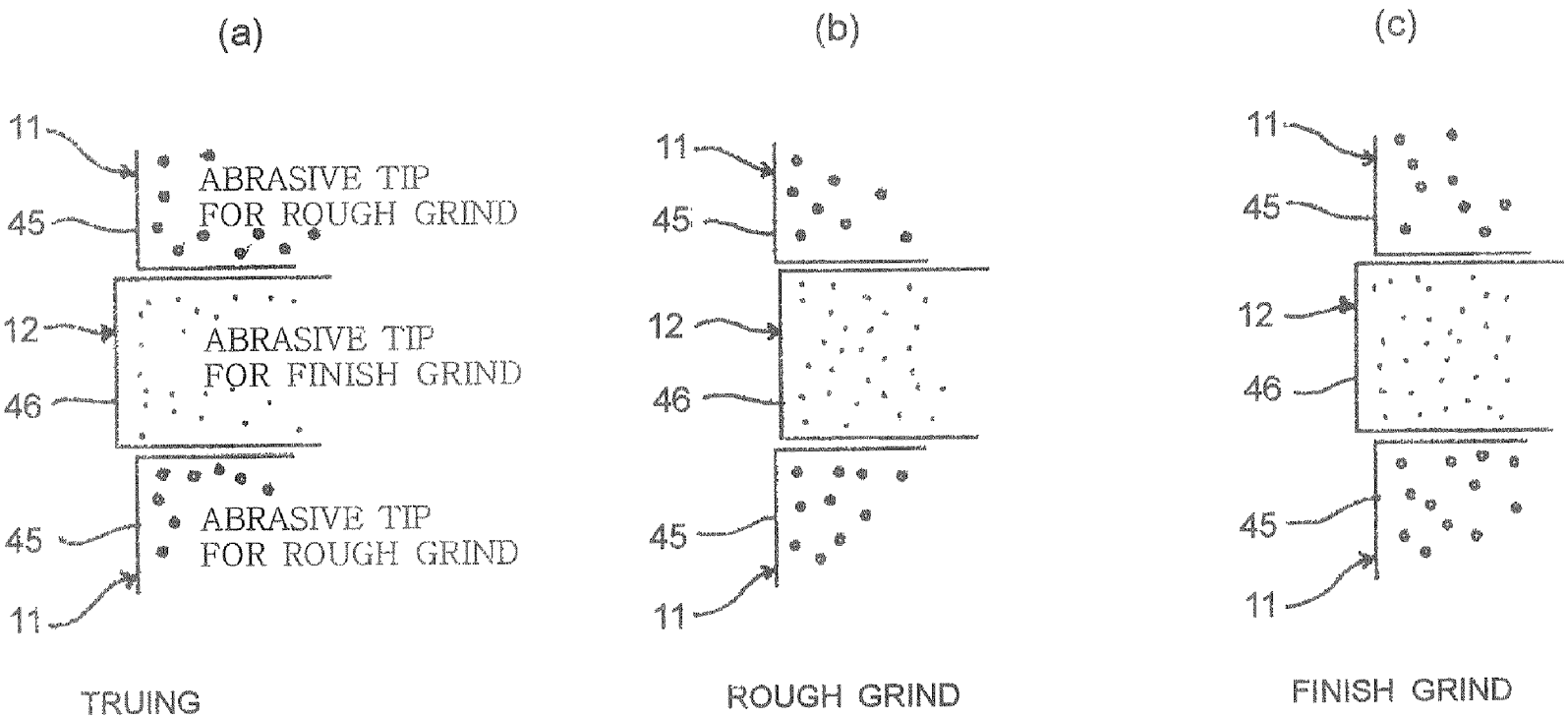
FIG. 3 illustrates states of the grinding surface of a grinding wheel during truing, rough-grinding, and finish-grinding.

When truing the grinding wheel 10, the truing tool 33 presses the grinding surfaces 45 and 46 of the abrasive tips 11 and 12 toward the inner center of rotation of the grinding wheel 10 with a strong force. Hence the abrasive tips 12 for finish grinding are elastically deformed and retreated toward the center of rotation of the grinding wheel 10 farther than the abrasive tips 11 for rough grinding, so that the grinding wheel is trued more amount at the abrasive tips 11 for rough grinding where the elastic deformation is less. For this reason, as illustrated in FIG. 3 (*a*), the grinding wheel 10 after truing has a slightly greater diameter at the grinding surfaces 46 of the abrasive tips 12 for finish grinding compared to the diameter at the grinding surfaces 45 of the abrasive tips 11 for rough grinding.

When grinding the workpiece W with the grinding wheel 10, the CNC 40 executes the NC program for grinding to output the rotation instruction for rotating the grinding wheel 10 at a high speed to the driving circuit 44 of the built-in Motor 37. Further, the CNC 40 outputs the rotation instruction for rotating the workpiece W at a circumferential speed suitable for grinding to the driving circuit 42 of the servo motor 32. Next, the traverse instruction for traversing the table 27 in the Z-axial direction to the position at which the workpiece W is opposite the grinding wheel 10 is outputted to the driving circuit 41 of the servo motor 28.

When the grinding wheel 10 is opposite a portion to be ground of the workpiece W, the advance instruction for advancing the grinding wheel head 34 in the X-axial direction at a rough grinding feed rate is outputted to the driving circuit 43 of the servo motor 35, so that the grinding wheel 10 performs rough grinding on the workpiece W while coolant is supplied from a coolant nozzle (not shown). When the rough grinding is performed, the depth of cut of the grinding wheel 10 towards the workpiece W is large, and thus the workpiece W presses the grinding surfaces 45 and 46 of the abrasive tips 11 and 12 toward the center of rotation of the grinding wheel 10 with a strong force. Therefore, as shown in FIG. 3 (*b*), the abrasive tips 12 for finish grinding are elastically deformed to move toward the center of rotation of the grinding wheel 10 more than the abrasive tips 11 for rough grinding. The workpiece W is rough-ground by the grinding surfaces 45 of the abrasive tips 11 for rough grinding, in which elastic deformation thereof is less.

When the rough grinding is completed, the instruction for advancing the grinding wheel head 34 in the X-axial direction at a finish grinding feed rate is outputted to the driving circuit 43 of the servo motor 35. At the final stage of the finish grinding, the feed of the grinding wheel 10 toward the workpiece is ceased. When the advance movement of the grinding wheel 10 is stopped, grinding by the abrasive tips 11 for rough grinding is not carried out, but as illustrated in FIG. 3 (*c*) the grinding surfaces 46 of the abrasive tips 12 for finish grinding are elastically restored to the outside farther than the grinding surfaces 45 of the abrasive tips 11 for rough grinding so as to perform finish grinding on the workpiece W.

In this manner, because the grinding surfaces 45 and 46 of the abrasive tips 11 and 12 for rough and finish grinding can be sequentially fed to the workpiece W depending on the depth of cut of the grinding wheel 10 toward the workpiece W, the workpiece W can be effectively subjected to rough grinding and finish grinding with using one grinding wheel 10.

In the first embodiment, in order to make the amount by which the grinding surface of abrasive tip 12 for finish grinding is displaced in the loading direction with respect to the load acting on the grinding surface of abrasive tip 12 in an inward direction of the grinding wheel 10 greater than that by which the grinding surface of abrasive tip 11 for rough grinding is displaced in the loading direction with respect to the load acting on the grinding surface of abrasive tip 11 in an inward direction of the grinding wheel 10, the Young's modulus of the binder 20 of the abrasive tips 12 for finish grinding is set so that it is less than that of the binder 15 of the abrasive tips 11 for rough grinding. However, it is not limited to this construction. Abrasive tip for finish grinding may be made up of a abrasive layer, at which superabrasive grains are bonded with a binder, and a lower layer that is overlaid and integrally formed with the abrasive layer, and the Young's modulus of the lower layer of the abrasive tip for finish grinding may be less than that of the lower layer of the abrasive tip 11 for rough grinding. Further, if the Young's moduli are equal to each other, the lower layer of each abrasive tip 12 for finish grinding may be thicker than that of the abrasive tip for rough grinding.

Further, in the first embodiment, the abrasive tips for rough and finish grinding are identical in the type of abrasive grain, which is CBN and are different in the abrasive grain size, the type of binder, and so on. However, depending on the material of the workpiece, the grinding conditions, and the like, the type of abrasive grain, the abrasive grain size, the abrasive grain ratio, the type of binder, the binder ratio, the specifics of the lower layer, etc. may be properly selected, so that the amount by which the grinding surface 46 of the abrasive tip 12 for finish grinding is displaced in the loading direction is greater than that by which the grinding surface 45 of the abrasive tip 11 for rough grinding is displaced in the loading direction.

Figure 4:
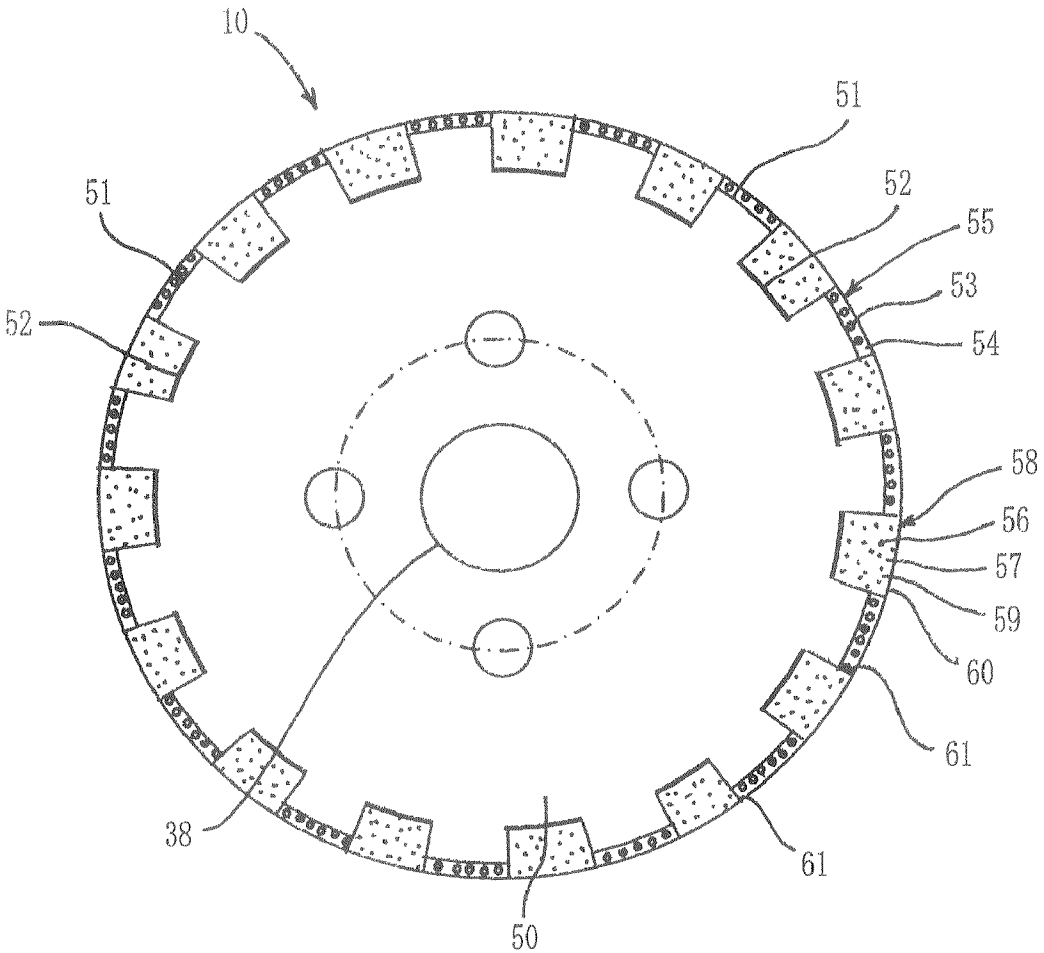
FIG. 4 is a front view illustrating a grinding wheel according to a second embodiment.

In the second embodiment, as illustrated in FIG. 4, on the peripheral surface of a disk type metal base 50, which is made of metal such as aluminum and is rotated about a rotation axis, 15 grooves are formed at an inclination angle of 45 degrees relative to the rotation axis at a predetermined interval, so that there are alternately provided fifteen land and recess regions 51 and 52. In each land region 51, CBN abrasive grains, as superabrasive grains 53 having, for example, a grain size of #60, are electrodeposited on a metal plating layer 54, to form an abrasive section 55 for rough grinding. The superabrasive grains 53 of CBN, diamond, etc. are electrodeposited on the surface of each land region 51 of the disk type metal base 50 by means of an electrolytic process, in which a metal layer of nickel chrome, etc. is formed by electroplating, or a non-electrolytic process, in which a metal layer is formed by electroless plating (chemical plating).

In each recess region 52, superabrasive grains 56 of CBN, diamond, etc. are bonded by a binder 57, the Young's modulus of which is less than that of a metal plating layer 54, and an abrasive section 58 for finish grinding is formed to have approximately the same diameter as the abrasive section 55 for rough grinding. As an examples CBN abrasive grains having a grain size of #800 are bonded with a resinoid binder such as phenol resin at a concentration of 30, to form the abrasive section 58 for finish grinding. The abrasive section 58 for finish grinding has a shape fitted into the recess region 52, and is formed with a abrasive tip 60 for finish grinding which has a phenol resin base containing no superabrasive grains 56, and a abrasive layer 59 formed by bonding the superabrasive grains 56 that is adhered with phenol resin to a periphery protruding from the recess region 52. The abrasive tip 60 for finish grinding is fitted and adhered in each recess region 52 with an adhesive.

Figure 5:
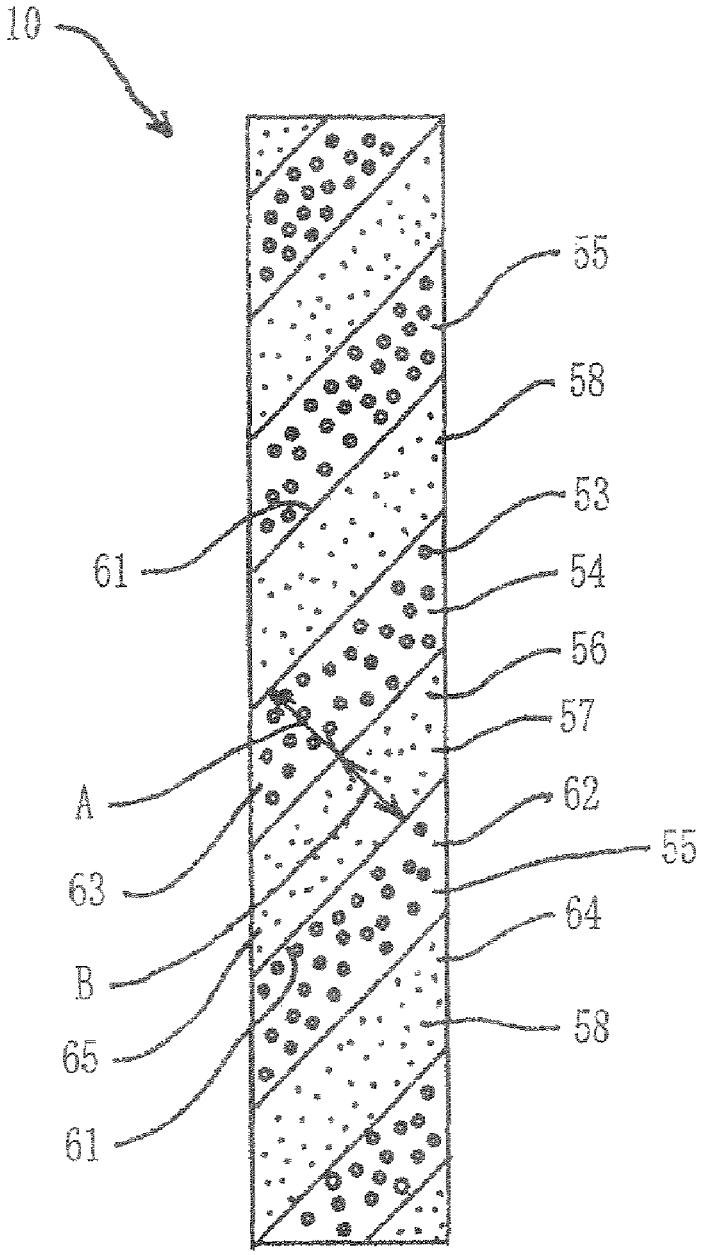
FIG. 5 is a side view illustrating a grinding wheel according to a second embodiment.

As illustrated in FIG. 5, the boundary 61 between the abrasive section 55 for rough grinding and the abrasive section 58 for finish grinding is inclined relative to the rotation axis. The abrasive section 55 for rough grinding has a width A equal to or greater than that B of the abrasive section 58 for finish grinding. The width B of the abrasive section 58 for finish grinding has a length at which opposite ends 62 and 63 of the two adjacent abrasive sections 55 for rough grinding, between which the abrasive section 58 for finish grinding is interposed, are overlaid with each other in the rotating direction of the grinding wheel 10. Thus, in the case of rough-grinding a workpiece W which is longer than the width of the grinding wheel 10, the grinding wheel 10 is always in contact with the workpiece W by means of the abrasive sections 55 for rough grinding, and the abrasive sections 58 for finish grinding are uniformly pressed and elastically deformed in the direction of the center of rotation of the grinding wheel 10 by means of the workpiece W, and are displaced in an inward direction of the grinding wheel 10 farther than the abrasive sections 55 for rough grinding.

Further, when the boundary 61 between the abrasive section 55 for rough grinding and the abrasive section 58 for finish grinding is inclined relative to the rotation axis of the grinding wheel 10, the width of the abrasive section 55 for rough grinding is equal to that of the abrasive section 58 for finish grinding, and the widths of the abrasive sections 58 and 55 for finish and rough grinding is equal to the lengths at which opposite ends 62, 63, 64 and 65 of the two adjacent abrasive sections 55 and 58 for rough and finish grinding between which the abrasive sections 58 and 55 for finish and rough grinding are interposed, are overlaid with each other at the same amount in the rotating direction of the grinding wheel 10, so that the total length of the abrasive sections 55 for rough grinding is equal to that of the abrasive sections 58 for finish grinding on any generating line of the grinding wheel 10. Thus, although the plurality of abrasive sections 55 and 58 having different properties are alternately bonded to the periphery of the disk type metal base 50, variation in grinding resistance during one turn of the grinding wheel 10 can be almost eliminated. The operation of the second embodiment is equal to that of the first embodiment, and so a detailed description thereof will be omitted.

In the first embodiment, the boundary between the abrasive tip 11 for rough grinding and the abrasive tip 12 for finish grinding is parallel to the rotation axis of the grinding wheel 10, but it can be inclined relative to the rotation axis of the grinding wheel, as in the second embodiment.

INDUSTRIAL APPLICABILITY

The grinding wheel according to the present invention is suitable for use on a grinding machine for grinding a workpiece with a grinding wheel, in which the grinding wheel head rotatably supporting the grinding wheel is moved relative to the workpiece supporting apparatus for supporting the workpiece.

The invention claimed is:

1. A grinding wheel in which abrasive tips for rough grinding and abrasive tips for finish grinding are alternately bonded to a periphery of a disk type base rotating about a rotation axis, wherein:

each abrasive tip includes the abrasive layer formed by bonding abrasive grains and a lower layer overlaid and integrally formed with the abrasive layer;

the abrasive tip is attached to the periphery of the base at the lower layer; and Young's modulus of the lower layer of the abrasive tip for finish grinding relative to a load acting on the grinding surface of the abrasive tip in an inward direction of the grinding wheel is less than a Young's Modulus of the lower layer of the abrasive tip for rough grinding.

2. The grinding wheel as claimed in claim 1, wherein the abrasive tip for finish grinding has a Young's modulus of a binder thereof less than a Young's Modulus of a binder of the abrasive tip for rough grinding.

3. The grinding wheel as claimed in claim 1, wherein the abrasive tip for finish grinding and the abrasive tip for rough grinding which are adjacent to each other are bonded by an adhesive having elasticity so that the abrasive tips for finish grinding and the abrasive tips for rough grinding are capable of independently undergoing elastic deformation in the loading direction.

4. The grinding wheel as claimed in claim 1, wherein at least one of the abrasive layer of the abrasive tip for rough grinding and the abrasive layer of the abrasive tip for finish grinding includes superabrasive grains.

5. The grinding wheel as claimed in claim 1, wherein:

boundaries between the abrasive tips or sections for rough and finish grinding which are adjacent to each other are inclined relative to the rotation axis; and the abrasive tip or section for finish grinding has a width at which opposite ends of two adjacent abrasive tips or sections for rough grinding between which the abrasive tip or section for finish grinding is interposed, are overlaid with each other in a rotating direction of the grinding wheel.

6. The grinding wheel as claimed in claim 5, wherein the abrasive tips or sections or rough grinding have a total length equal to taut of the abrasive tips or sections for finish grinding on any generating line of the grinding wheel.

7. A grinding wheel in which a plurality of abrasive tips having different properties are alternately bonded to a periphery of a disk type metal base rotating about a rotation axis and the abrasive tip has an abrasive layer formed by bonding abrasive grains, wherein:

the periphery of the disk type metal base is alternately provided with land regions and recess regions; and the abrasive tips include abrasive sections for rough grinding formed by electrodepositing superabrasive grains on metal plating layers in the land regions, and abrasive sections for finish grinding formed by bonding the abrasive grains with a binder wherein a Young's modulus of the binder for finish grinding is less than a Young's Modulus of the metal plating layer of the rough grinding section.

8. The grinding wheel as claimed in claim 7, wherein:

boundaries between the abrasive tips or sections for rough and finish grinding which are adjacent to each other are inclined relative to the rotation axis; and the abrasive tip or section for finish grinding has a width at which opposite ends of two adjacent abrasive tips or sections for rough grinding, between which the abrasive tip or section for finish grinding is interposed, are overlaid with each other in a rotating direction of the grinding wheel.

9. The grinding wheel as claimed in claim 8, wherein the abrasive tips or sections for rough grinding have a total length equal to that of the abrasive tips or sections for finish grinding on any generating line of the grinding wheel.

* * * * *